US011572703B2

(12) United States Patent
Baker

(10) Patent No.: US 11,572,703 B2
(45) Date of Patent: Feb. 7, 2023

(54) POOL GUTTER AND AIR EXHAUST ASSEMBLY

(71) Applicant: Paddock Pool Equipment Company, Rock Hill, SC (US)

(72) Inventor: Donald Cyrus Baker, Clover, SC (US)

(73) Assignee: Paddock Pool Equipment Company, Rock Hill, SC (US)

( * ) Notice: Subject to any disclaimer, the term of this patent is extended or adjusted under 35 U.S.C. 154(b) by 60 days.

(21) Appl. No.: 17/183,649

(22) Filed: Feb. 24, 2021

(65) Prior Publication Data

US 2021/0285247 A1 Sep. 16, 2021

Related U.S. Application Data

(60) Provisional application No. 62/990,219, filed on Mar. 16, 2020.

(51) Int. Cl.
*E04H 4/12* (2006.01)
*E04H 4/14* (2006.01)

(52) U.S. Cl.
CPC ..... *E04H 4/1227* (2013.01); *E04H 4/14* (2013.01)

(58) Field of Classification Search
CPC ..... E04H 4/1227
USPC ..... 4/510, 512, 507
See application file for complete search history.

(56) References Cited

U.S. PATENT DOCUMENTS 3,668,712 A * 6/1972 Baker ..... E04H 4/1227 4/510
3,668,713 A * 6/1972 Baker ..... E04H 4/1227 4/512
3,668,714 A * 6/1972 Baker ..... E04H 4/1227 4/510
3,815,160 A * 6/1974 Baker ..... E04H 4/1227 4/510
3,890,230 A * 6/1975 Patterson ..... E04H 4/1227 4/510
3,923,230 A * 12/1975 Patterson ..... E04H 4/1227 4/510
4,050,104 A * 9/1977 Baker ..... E04H 4/1227 4/510

(Continued)

FOREIGN PATENT DOCUMENTS

CA 2742065 6/2011

OTHER PUBLICATIONS

Copending U.S. Appl. No. 16/704,120, filed Dec. 15, 2019.

*Primary Examiner* — Lori L Baker

(74) *Attorney, Agent, or Firm* — Greer, Burns & Crain, Ltd.

(57) ABSTRACT

A pool perimeter assembly extending along a portion of a pool perimeter includes a combined gutter assembly having a gutter conduit and a grate supported above the gutter conduit. The combined gutter assembly also has a partition dividing the gutter conduit to form an exhaust air plenum on one side of the partition. A surge tank is fluidly connected to through a modified converter box and a water-air line to the exhaust air plenum. An exhaust fan is connected to the surge tank and generates below atmospheric pressure so that the contaminated air on the pool surface is drawn through the grate and into the exhaust air plenum, through the water-air line, into the surge tank, and of the surge tank through the exhaust fan.

5 Claims, 4 Drawing Sheets

(56) References Cited

U.S. PATENT DOCUMENTS 4,059,856 A * 11/1977 Patterson ..... E04H 4/1227 4/510
4,112,526 A * 9/1978 Patterson ..... E04H 4/1227 4/510
4,115,877 A * 9/1978 Wall ..... G01L 9/0095 73/304 C
4,133,059 A * 1/1979 Baker ..... E04H 4/1209 4/494
4,146,937 A * 4/1979 Baker ..... E04H 4/1227 405/96
4,206,522 A * 6/1980 Baker ..... E04H 4/1227 4/512
4,389,739 A * 6/1983 Baker ..... E04H 4/1227 4/510
4,494,257 A * 1/1985 Peirish ..... E04H 4/1227 4/510
4,542,544 A * 9/1985 Baker ..... E04H 4/1227 4/510
4,627,118 A * 12/1986 Baker ..... B01D 24/48 210/167.13
4,758,292 A * 7/1988 Baker ..... E04H 4/1227 156/196
5,425,145 A * 6/1995 Baker ..... E04H 4/1227 4/510
5,930,850 A * 8/1999 Baker ..... E04H 4/1227 4/510
8,999,027 B1 4/2015 Baxter
9,540,836 B2 1/2017 Baker
9,631,387 B2 4/2017 Baker
10,072,868 B2 9/2018 Baker
10,697,190 B2 * 6/2020 McDuffie ..... E04H 4/1227
10,774,555 B2 * 9/2020 Baker ..... E04H 4/1227
11,149,456 B2 * 10/2021 McDuffie ..... E04H 4/14
2010/0071917 A1 * 3/2010 Lalouz ..... A62C 3/0214 169/60
2019/0284825 A1 * 9/2019 Baker ..... E04H 4/1227
2019/0316372 A1 * 10/2019 Baker ..... E04H 4/1227
2021/0172187 A1 * 6/2021 McDuffie ..... E04H 4/12
2021/0285247 A1 * 9/2021 Baker ..... E04H 4/1227

* cited by examiner

POOL GUTTER AND AIR EXHAUST ASSEMBLY

CROSS-REFERENCE TO RELATED APPLICATION

This application claims the benefit of priority from U.S. Provisional Patent Application 62/990,219 filed Mar. 16, 2020, the entire disclosure of which is incorporated herein by reference in its entirety.

FIELD OF THE DISCLOSURE

This disclosure relates to devices installed around a pool perimeter including gutter assemblies directing water from the pool to a filtration system and exhaust assemblies directing contaminate laden air from the surface of the pool and into an exhaust system.

BACKGROUND

The chemicals used to treat water in a swimming pool create contaminants that may be harmful to swimmers and others present within an enclosure housing a swimming pool (i.e., natatorium). The water in the swimming pool also creates water vapor (i.e., humidity) within the swimming pool facility. The contaminants (e.g., chloramine) can irritate the eyes and air passages of individuals in and around the pool area. The contaminants such as chloramine are present in the air within the swimming pool enclosure, but are concentrated in an area immediately above the surface of the swimming pool. Unfortunately, greater amounts of chloramine are created when the swimming pool is in use due to swimmers agitating the water (e.g., swimming and splashing). Moreover, the high humidity within the enclosure creates an uncomfortable environment for individuals and can affect the physical structure (e.g., girders and roofing) forming the enclosure (e.g., corrosion).

Moreover, the high humidity formed within the enclosure housing a swimming pool requires that a heating, ventilating, and air conditioning (HVAC) system run almost continuously to circulate and dehumidify the air contained within the enclosure. In addition, the HVAC system runs nearly continuously to circulate the air in order to avoid high concentrations of contaminants in the air.

It is desirable therefore to reduce the levels of contaminants and humidity within the enclosure housing a swimming pool. Moreover, it is desirable for swimming pool facilities to improve the efficiency of the HVAC system in order to reduce costs associated with circulating, filtering, and dehumidifying the air within the swimming pool facility.

Accordingly, the present invention addresses the requirements for an energy-efficient apparatus and method for evacuating contaminants and water vapor from a swimming pool facility.

BRIEF SUMMARY OF THE DISCLOSURE

A pool perimeter assembly extending along a portion of a pool perimeter includes a combined gutter assembly having a gutter conduit and a grate supported above the gutter conduit. The combined gutter assembly also has a partition dividing the gutter conduit to form an exhaust air plenum on one side of the partition. A surge tank is fluidly connected to through a modified converter box and a water-air line to the exhaust air plenum. An exhaust fan is connected to the surge tank, and the exhaust fan generates below atmospheric pressure within the surge tank and the exhaust air plenum so that the contaminated air on the pool surface is drawn through the grate and into the exhaust air plenum, through the water-air line, into the surge tank, and out of the surge tank through the exhaust fan.

A combined gutter assembly for a pool perimeter includes a gutter conduit located on a pool-side and having a grate supported above the gutter conduit, and an exhaust air plenum located on a deck-side and having the grate supported above the exhaust air plenum. The exhaust air plenum has a water-air line to communicate contaminated air out of the exhaust air plenum. A partition defines the gutter conduit on one side and the exhaust air plenum on the opposite side. The partition also has an opening to permit water to flow between the gutter conduit to the exhaust air plenum.

A water filtering and return assembly for a pool perimeter having a combined gutter assembly includes a modified converter box having a drain to receive fluid from an exhaust air plenum. The filtering and return assembly also includes a water-air line in fluid communication and downstream of the modified converter box, and a surge tank in fluid communication and downstream of the water-air line. The filtering and return assembly is for a combined gutter assembly having an exhaust air plenum partitioned from a gutter conduit, and the filtering and return assembly fluidly connects the surge tank to the exhaust air plenum through the modified converter box and the water-air line. An exhaust fan in downstream fluid communication with the surge tank generates below atmospheric pressure within the surge tank and the exhaust air plenum, so that the contaminated air on the pool surface is drawn through the exhaust air plenum, through the water-air line, into the surge tank, and out of the surge tank through the exhaust fan.

Further objects and advantage of the disclosure will become apparent to those of reasonable skill in the art from the following detailed description, as considered in conjunction with the accompanying drawings.

DETAILED DESCRIPTION

Figure 1:
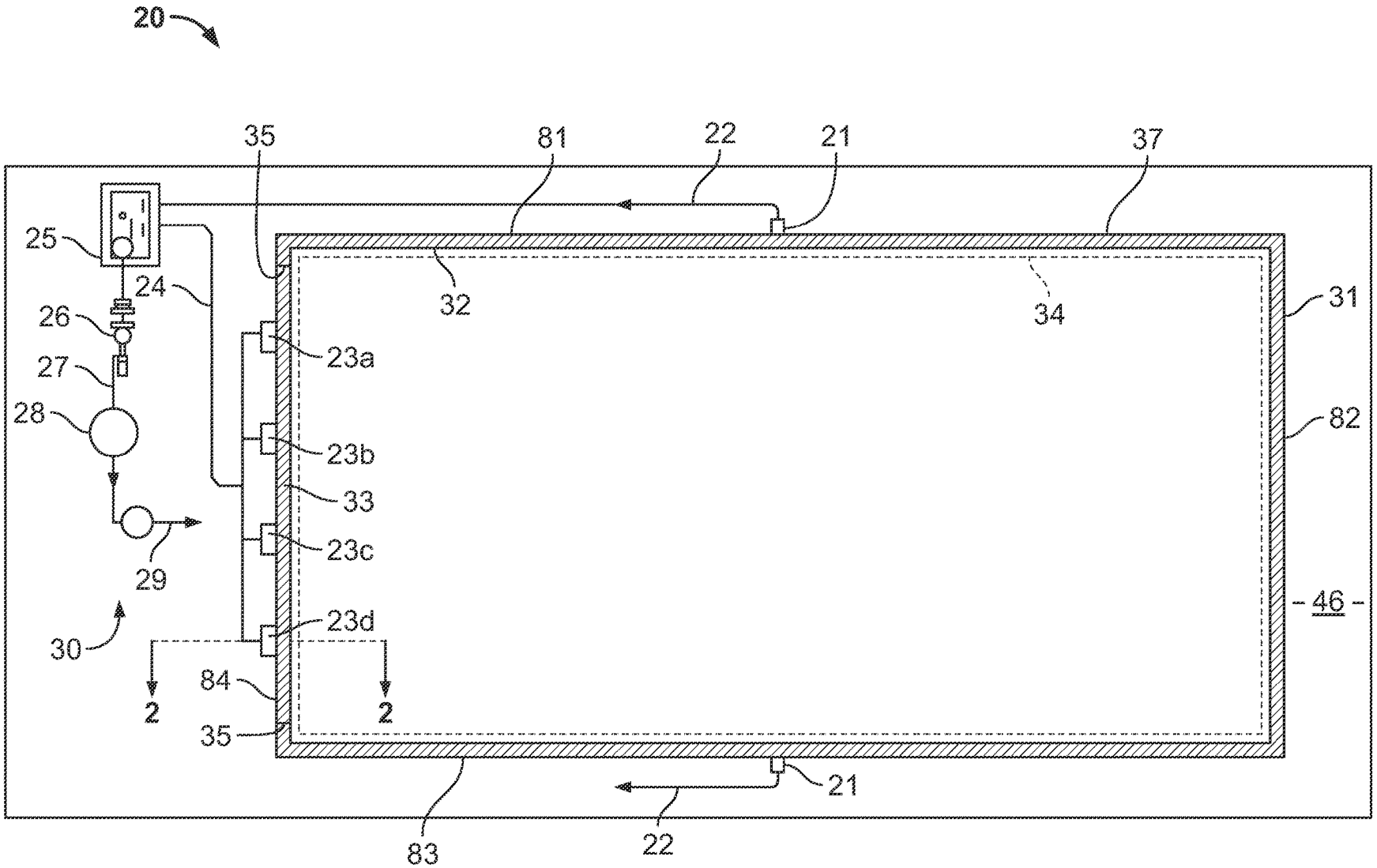
FIG. 1 is a plan view of a swimming pool having a first embodiment of a perimeter gutter and contaminated air exhaust assembly of the disclosure.

Turning now to the drawings, an embodiment of a pool perimeter assembly (20) is shown in FIG. 1. Three of four sides (81, 82, 83) of a pool perimeter comprise a conventional gutter system (31) for receiving and draining backsplash pool water. A preferred embodiment of the perimeter gutter system comprises a gutter conduit (32) and a filtered water return conduit, indicated schematically at (34) in FIG. 1. The filtered water return conduit may extend around the entire perimeter of the pool as illustrated in FIG. 1. However, in other embodiments the filtered water return conduit extends only partially around the pool perimeter. A plurality of converter boxes (21) collect water from the gutter conduit and convey the same (arrow (22)) to a water filtering and return system, indicated generally at (30). The water filtering and return system comprises a surge tank (25), a strainer (26), a pump, filter (28), and filtered water return line (29) that conveys the filtered water to the filtered water return conduit (34). The particular components, design and configuration of the water filtering and return system (30) may vary to meet regulatory requirements for clean liquids/water in the pool, as is known in the art.

FIG. 1 further illustrates that a fourth side (84) of the pool perimeter comprises a combined gutter and contaminate laden air exhaust assembly (33). At least one, preferably several modified converter boxes (23*a-d*) are provided to collect water and exhaust contaminate laden air, as described in greater detail below. The modified converter boxes are connected by combined water-air lines (24) to surge tank (25). Bulkheads (35) close the ends of the combined gutter assembly and separate the combined gutter assembly (33) from the gutter assembly (32).

Figure 2:
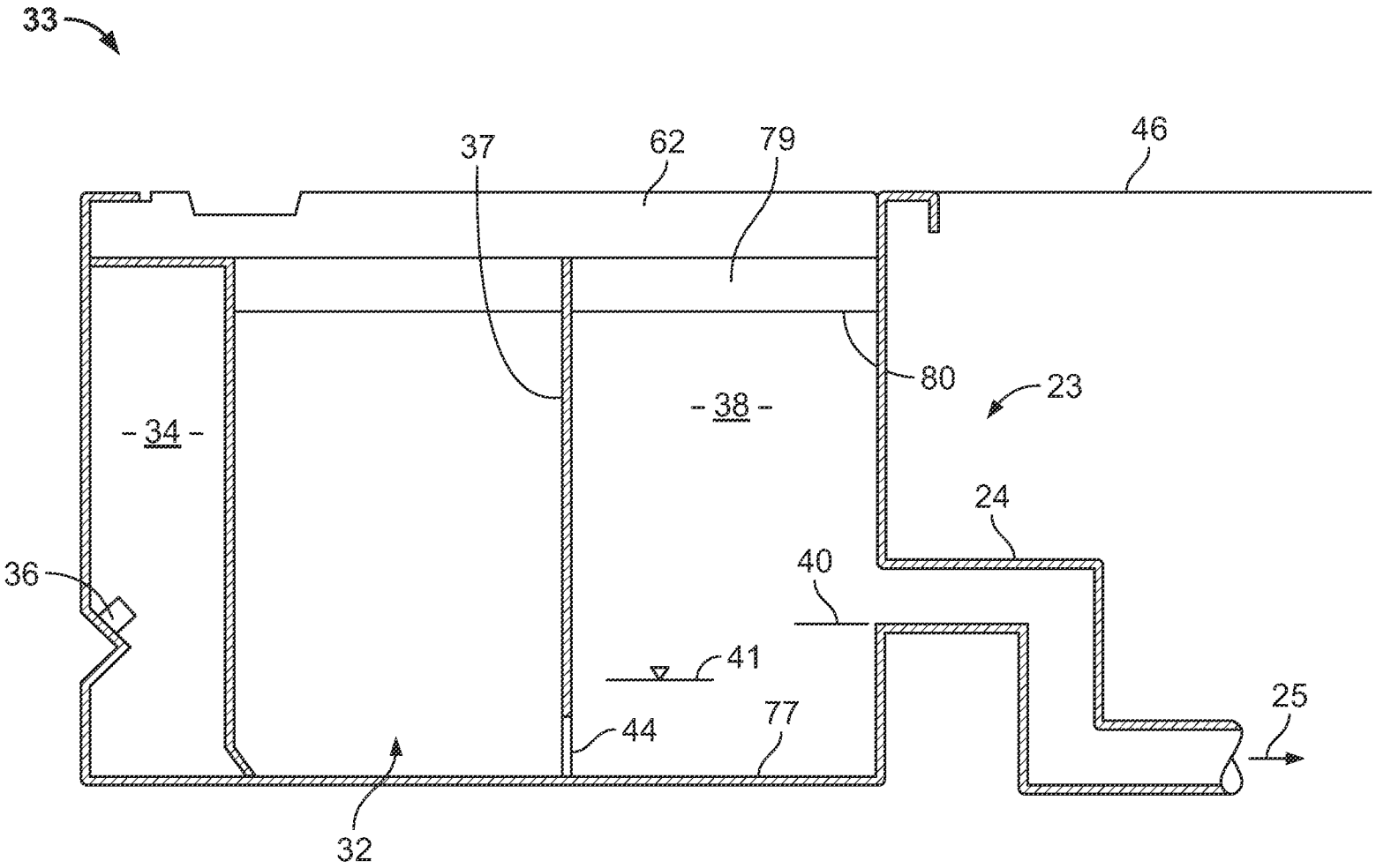
FIG. 2 is a transverse cross-sectional view of the perimeter gutter and contaminated air exhaust assembly taken along line 2-2 of FIG. 1.

Turning now to FIG. 2, the combined gutter assembly (33) comprises a filtered water return conduit (34) and a gutter conduit (32) into which backsplash from the pool enters through a grate (62). The filtered water return conduit (34) is preferred, but not essential to this disclosure. The filtered water return conduit (34) includes spaced water return nozzles (36). The grate (62) is supported on the assembly (33) by a support structure (79) that includes a downwardly projecting flange (80). The gutter conduit (32) is partially divided by a partition (37) to define contaminate laden air exhaust plenum (38). The modified converter box (23) comprises a combined water drain and air exhaust line (24) that conveys water and contaminated air to the surge tank (25). Turbulent flow of water in the water-air line causes entrained chloramine to be released and exhausted. Further, water-air line (24) is oversized without traps to allow for unrestricted air flow. The invert (40) of the water-air line (24) is spaced above a base (77) of the gutter conduit so as to maintain a normal operating level (41) of water in the combined water and air exhaust gutter (33).

Figure 3:
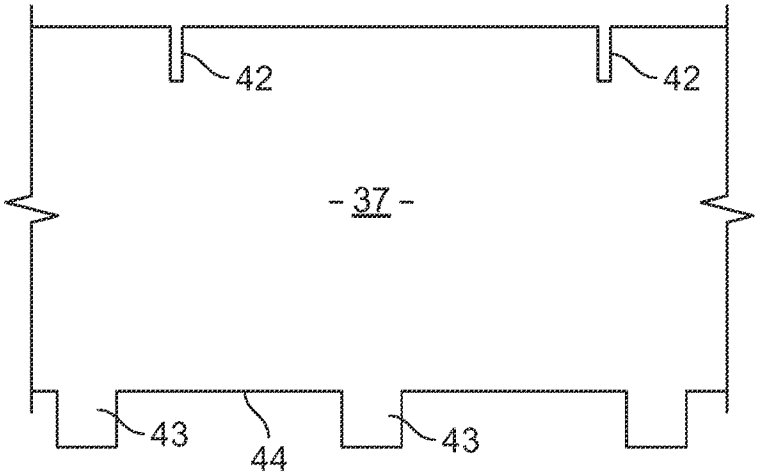
FIG. 3 is a partial longitudinal elevation of a gutter partition.

Partition (37) as shown in FIGS. 2 and 3 comprises a plurality of spaced notches (42) in an upper portion of the partition and a plurality of spaced feet (43) on the lower portion of the partition. The notches (42) in the upper portion of the partition are configured to receive and engage flanges (80) of the grate support members. The partition can be secured in the gutter conduit by attaching feet (43) to the base (77) of the gutter conduit by tack welding, for example. Openings (44) are defined between the partition feet (43) to permit water to flow between compartments. The assembly is configured such that the partition extends upwardly proximate to the bottom of grate (62) and the normal operating water level (41) in the gutter conduit is above the top of partition openings (44). Thereby, the partition (37) partially seals off air plenum (38).

Figure 4:
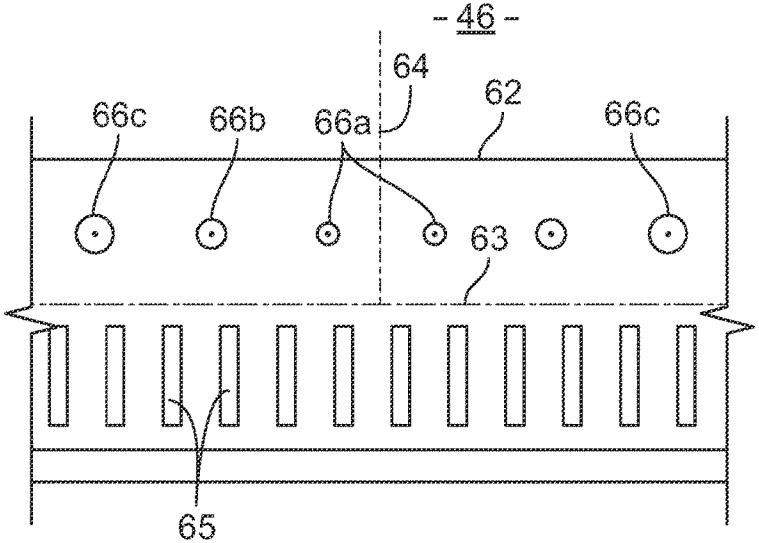
FIG. 4 is a partial plan view of a gutter grate.

Turning now to FIG. 4, a longitudinal centerline (63) of grate (62) represents the position of the partition (37) beneath the grate (62). Preferably, few if any drain ports are located along the centerline so as to limit the amount of air passing between the bottom of the grate and top of the partition. Transverse centerline (64) represents the position of a modified converter box (23). The pool side of the grate includes multiple drain ports (65) for receiving back-splash water from the pool and deck, and draining the same into the gutter conduit (32). The deck (46) side of the grate includes a second pattern of air exhaust ports (66*a-c*). The cross-sectional area of the exhaust ports (66*a*) that are closer to the modified converter box are comparatively small, and increase in cross-sectional area (66*b* and 66*c*) with distance from the modified converter box, as shown schematically in FIG. 4. The number, shape and size of the exhaust ports are configured such that the draw of contaminate laden air from above grate (62) is substantially uniform across the longitudinal length of the combined water and air exhaust gutter (33), as is well known in the art. In addition to receiving contaminate laden air, exhaust ports 66 may receive some back-splash water from the pool.

Figure 5:
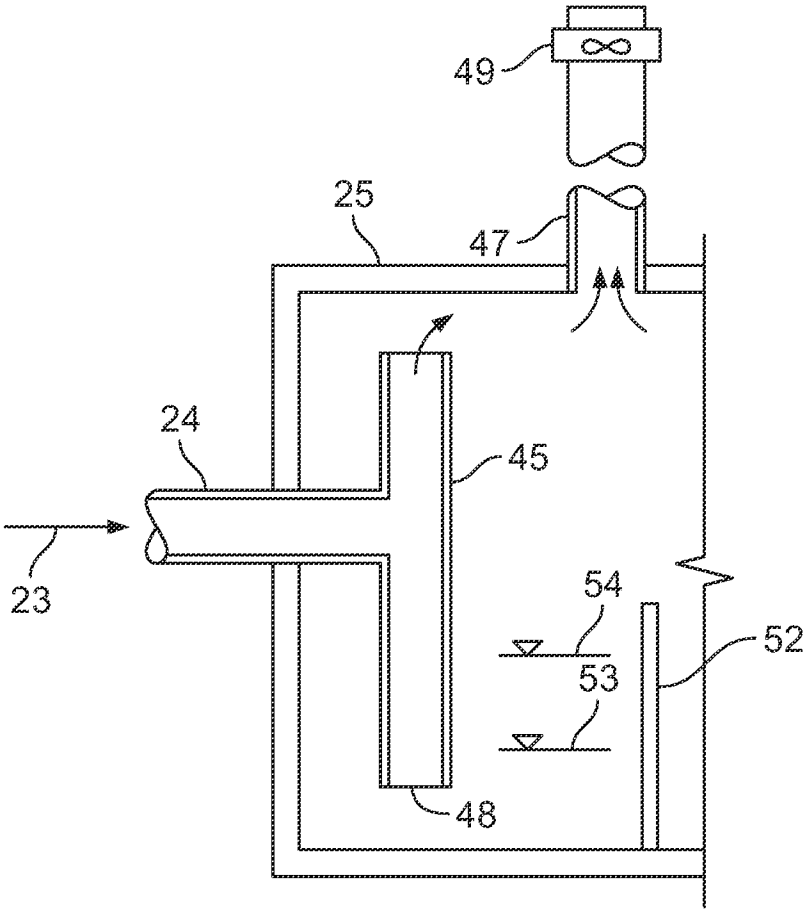
FIG. 5 is a partial cross-sectional view of a surge tank.

FIG. 5 is a cross-sectional view of the surge tank (25). Combined water-air line (24) extends into the surge tank. An optional Tee fitting (45) is preferably provided to facilitate directing water downwardly into the tank, and contaminate laden air upwardly as shown. A water line (not shown) is provided to draw water from the surge tank through the filter, pump and other components of the water filtration system (30). An automatic water level controller (52) is preferably located within surge tank (25) to control the water level between a minimum level (53) that is above the lower opening (48) of the Tee fitting and a predetermined maximum water level (54). An exhaust stack (47) is provided in an upper portion of the surge tank that is connected to an exhaust fan or blower (49), which is preferably located exterior to the natatorium housing the swimming pool, and which may emit the contaminated air to the ambient or direct it for treatment. The exhaust fan operates to generate below atmospheric pressure within the interior of the surge tank and within the exhaust air plenum (38) of the combination water and air exhaust gutter assembly (33). The partition (37) within the gutter assembly (33) functions to partially seal the exhaust air plenum (38). The number, size and cross-sectional area of the exhaust ports (66) in the grate, the configuration and size of water-air line (24), and the capacity of exhaust fan (49) are sized and configured to maximize the effectiveness of the intake and exhaust of contaminant laden air. Furthermore, the natatorium HVAC systems is preferably configured to push air across the surface of the pool into the combined water and air exhaust gutter assembly (33) and into the air exhaust system.

In the embodiment shown in the drawings and described above, the combined water and air exhaust gutter (33) and modified converter boxes (23) are located at one end of the swimming pool. In other embodiments this assembly can be located at other places along the pool perimeter and with shorter or longer lengths. The assembly of the disclosure may extend around the entire perimeter of the pool if desired.

Further embodiments of the disclosure may comprise converting existing steel or concrete gutter systems to provide contaminant laden air exhaust functionality. Specifically, partitions (37) and bulkheads (35) can be installed in a portion of a previously existing gutter to form a combined water and exhaust air gutter assembly (33) in accordance with the disclosure. The invert of an existing converter box can be raised, or alternatively, one or more modified converter boxes (23) can be provided. Depending on the installation, the existing surge tank may require modification, including the provision of a stack and exhaust fan (49). Preferably a new grate (62) is provided to optimize air flow and to maximize exhaust of contaminant laden air in accordance with the disclosure.

While a preferred embodiment of the pool gutter and air exhaust assembly has been herein illustrated and described, it is to be appreciated the various changes, rearrangements and modifications may be made therein without departing from the scope of the disclosure.

The invention claimed is:

1. A combined gutter assembly for a pool perimeter comprising:

a gutter conduit located on a pool-side and having a grate supported above the gutter conduit;

an exhaust air plenum located on a deck-side and having the grate supported above the exhaust air plenum, the exhaust air plenum having a water-air line configured for exhausting contaminated air out of the exhaust air plenum; and a partition defining the gutter conduit on one side and the exhaust air plenum on the opposite side, wherein the partition has an opening that permits water to flow between the gutter conduit to the exhaust air plenum.

2. The combined gutter assembly of claim 1 wherein the grate has at least one port extending through the grate and in fluid communication with the exhaust air plenum.

3. The combined gutter assembly of claim 2 wherein the at least one port comprises multiple ports extending through the grate and in fluid communication with the exhaust air plenum.

4. The combined gutter assembly of claim 3 wherein the grate has a transverse centerline, wherein a cross-sectional area of each of the multiple ports increases with distance from the transverse centerline.

5. The combined gutter assembly of claim 1 wherein the partition includes a plurality of spaced feet on a lower portion of the partition that are attached to a base of the gutter conduit.

* * * * *